US006202884B1

(12) United States Patent
Verkerke

(10) Patent No.: US 6,202,884 B1
(45) Date of Patent: Mar. 20, 2001

(54) COLLAPSIBLE INTERIOR PARTITION SYSTEM FOR USE IN A COLLAPSIBLE RETURNABLE CONTAINER

(75) Inventor: Jeffrey Alan Verkerke, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/342,471

(22) Filed: Jun. 29, 1999

(51) Int. Cl.[7] ..... B65D 6/00
(52) U.S. Cl. ..... 220/530; 220/6; 206/583
(58) Field of Search ..... 220/6, 404, 530, 220/23.83, 7, 406, 403, 909; 206/583, 425; 312/183, 184

(56) References Cited

U.S. PATENT DOCUMENTS 4,775,069 * 10/1988 Stonier ..... 220/6
5,211,290 * 5/1993 Janus et al. ..... 206/583
5,725,119 * 3/1998 Bradford et al. ..... 220/530 X
5,881,895 * 3/1999 Linnell ..... 220/6 X

* cited by examiner

*Primary Examiner*—Steven Pollard
(74) *Attorney, Agent, or Firm*—Laurence R. Letson

(57) ABSTRACT

A collapsible shipping container is provided with channels formed into the interior surface of the top frame of the collapsible shipping container to accept support rods and interior dunnage which depend from the support rods. The interior dunnage preferably is fabricated of flexible or foldable material which may be gathered and positioned such that the collapsible shipping container may be collapsed while the dunnage remains at all times within and associated with the collapsible shipping container. The dunnage may be in the form of hanging pouches supported by support rods and may further include hanging curtains supported by support rods orthogonally intersecting the pouch support rods. Whenever the hanging curtains are utilized, the hanging pouches are made of material which permits and forms a gap between adjacent pouches to accommodate the curtains. Should the items being shipped need protection from electrostatic discharge, electrically conducting pliable material may be used to form the pouches and/or the curtains supported by the support rods.

10 Claims, 5 Drawing Sheets

COLLAPSIBLE INTERIOR PARTITION SYSTEM FOR USE IN A COLLAPSIBLE RETURNABLE CONTAINER

FIELD OF THE INVENTION

This invention relates to collapsible shipping containers and, more specifically, to a collapsible shipping container designed or adapted to retain collapsible interior dunnage and partition systems within the collapsed shipping container itself for a return shipment or storage.

BACKGROUND OF THE INVENTION

The use of reusable shipping containers has become a practice in industry for several reasons. First, reusable containers are sturdy and provide a high level of protection to shipped items compared to the customary, corrugated fiberboard containers. Second, the lifetime cost per use is generally less for a reusable shipping container. Third, environmental considerations weigh in favor of reusable containers which require less frequent replacement and offer various recycling options.

Return shipments of collapsible reusable shipping containers to the originating shipper are more economical and efficient than non-collapsible units. Collapsing the shipping container to a fraction of its erected size allows a more dense load to be shipped, as it may cost no more to ship three to four times the number of collapsed containers than to ship a lesser number in an erected condition. This is particularly true if the freight charge is calculated, not by weight, but either on a truck load basis or on a set volume of freight.

For those items requiring individual packaging during shipment and handling, collapsible shipping containers as previously designed have not been an advantageous choice. A major problem with current collapsible shipping containers is the separate interior dunnage itself, dividers and separators. This has been true whether shipment is made to assembly operations, between locations within a single facility, or over distances as from a supplier to a manufacturer.

One handling problem with conventional dunnage is that the dunnage or internal packaging must be removed from a shipping container and disassembled or collapsed separately, or it becomes an obstacle and interferes with the collapsing of the collapsible shipping container. Once removed, the conventional dunnage is no longer a part of the container assembly, requires separate handling, shipment and accounting and, further, is subject to loss or damage. Thus, the advantages of the collapsible, reusable shipping container for shipments of unpackaged items diminish with the handling requirements for the currently designed separate dunnage. Moreover, once removed and shipped as a separate item, dunnage consumes space in the return shipment and reduces return shipment efficiencies.

Dunnage in the form of corrugated fiberboard orthogonally interdigitated dividers, left assembled and collapsed, typically collapse to a dimension larger than the footprint of its collapsible shipping container and create additional handling problems. Completely disassembled, these dividers compound the problem of return shipment and require disassembly and re-assembly labor. In the instance of conductive or conductively coated dunnage for shipment of electronic circuit boards and circuits having electrostatic discharge sensitive components, separate handling of the collapsed interlocked dunnage tends to degrade those properties which are responsible for protection against electrostatic discharge damage to electronic circuit boards.

These and other shortcomings can prevent efficient and cost effective use of collapsible reusable shipping containers for shipping fragile items requiring separation and protection from incidental contact during shipping and handling.

OBJECTS OF THE INVENTION

It is an object of the invention to protect items shipped in a collapsible shipping container by means of dunnage which itself is enclosed within the collapsible shipping container and is erect for usage or in a collapsed state.

It is another object of the invention to provide collapsible interior dunnage which remains within its collapsible shipping container during container usage or return shipment.

It is a further object of the invention to render a collapsible shipping container usable for shipping fragile items which ordinarily require protective packaging without individually packaging the items.

It is still another object of the invention to improve the usability of collapsible shipping containers.

It is a still further object of the invention to improve the efficiency of use of collapsible shipping containers.

It is an additional object of the invention to reduce the shipping expense of collapsible shipping containers and associated dunnage as well as any associated labor savings.

SUMMARY OF THE INVENTION

In order to incorporate dividers or dunnage into a collapsible shipping container in a manner to insure at all times the association of the dunnage with its container yet not to impede the collapse of the container for return shipment, a collapsible shipping container is provided with at least a pair of channels in the top frame attached to the top edges of the four side walls of the container. These channels, disposed in the top frame sides that are opposed to each other, support and retain support rods with flanges on their ends.

Rods spanning the opposed top frame side channels, and the collapsible shipping container interior together support a preferably flexible material forming a hanging pouch or pouches for receiving individual items to be shipped and for protecting each item from contact with another item. Preventing contact between items protects them from damage during shipping and handling.

The hanging pouch may extend substantially across the container interior to accept a single item or may be divided longitudinally and arranged with laterally extending dividers or curtains suspended from rods supported by a pair of opposing channels disposed in orthogonal segments of the frame. This arrangement creates a plurality of small pouches for supporting and isolating smaller items.

Whenever the curtains are used, the curtain supporting rods should be preferably disposed below the rods supporting the material forming the hanging pouches.

The dunnage may be replaced as worn or damaged with use and can be changed to accommodate changes in items shipped, thus making the shipping container more beneficial.

These dunnage arrangements lend themselves to easy collapse and erection plus remain confined in and directly associated with the container during all phases of use and shipment in order that the dunnage is not lost or separated from its container which would significantly reduce their utility.

DETAILED DESCRIPTION OF THE PREFERRED EMBODIMENT

OF THE BEST MODE OF THE INVENTION AS CONTEMPLATED BY THE INVENTOR

Figure 1:
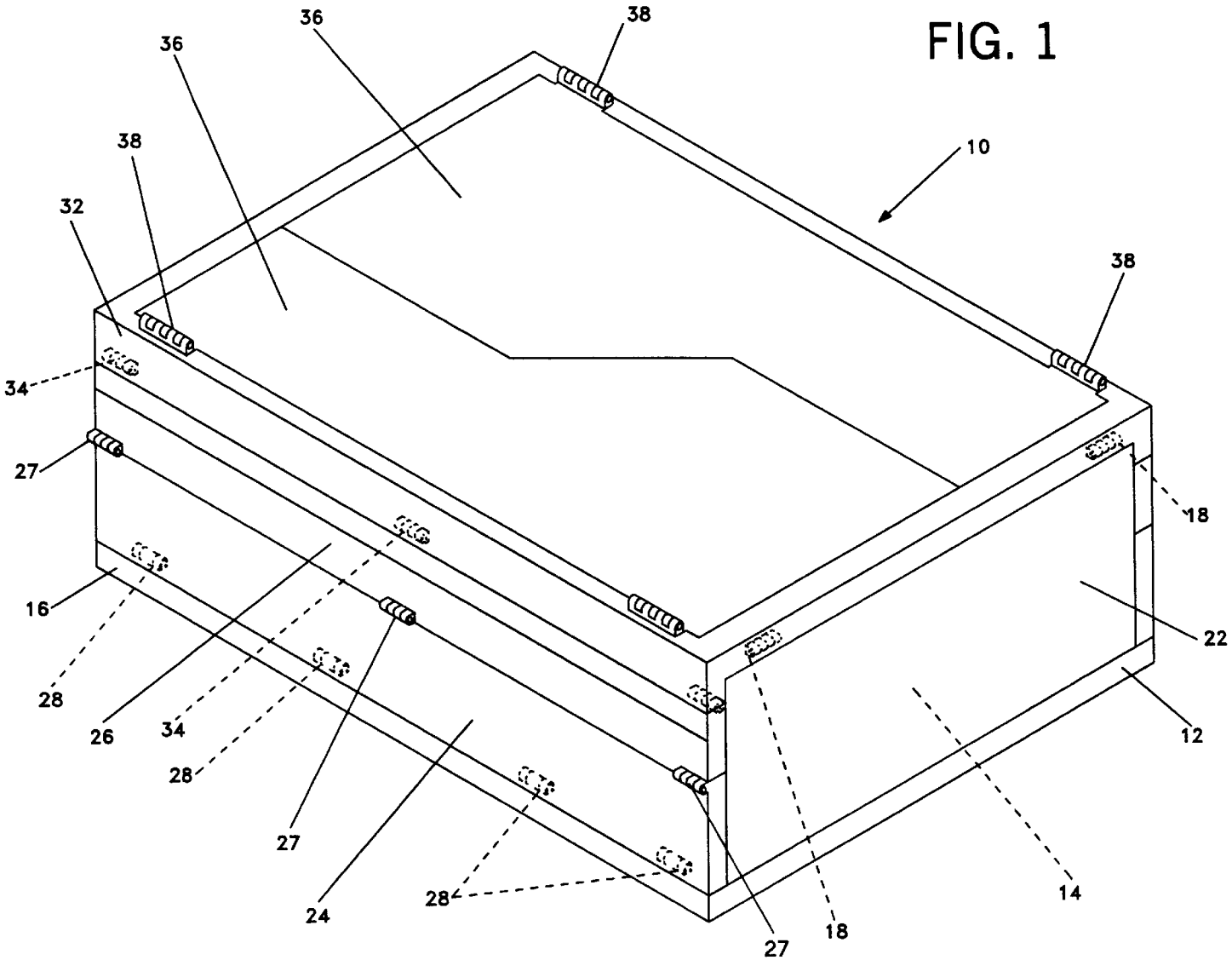
FIG. 1 illustrates a collapsible shipping container in an erected, closed state.

Initially, reference is made to FIG. 1. The collapsible shipping container 10 illustrated is typically assembled from injection molded plastic parts. Bottom member 12 is molded to include a partial hinge 28 on two of its four edge portions 16 in an opposing arrangement. Forming hinge 29 is partial hinge 28 and partial hinge 30 which is molded as a part of side panel 24 of collapsible shipping container 10. Pivotally attached at hinge 27 to side panel 24 is a similar side panel 26. Side panel 26 is further hinged at hinge 34 to top frame 32. Hinges 29, 27 and 34 thus connect side panel segments 24, 26 to bottom 12 and to top frame 32 forming a collapsible wall. The same arrangement is found on the opposing wall (not visible) of collapsible shipping container 10.

Covers 36 are pivotally attached to the top frame 32 at edge hinges 38, thereby permitting the covers 36 to be laid open.

End panel 22 of collapsible shipping container 10 is hinged to top frame 32 and functions as a rigid compression member once collapsible shipping container 10 is fully erected. A second end panel 22 is similarly found at the opposite end of collapsible shipping container 10. The end panels 22 are rigid and strong enough in an erected state to support not only the top frame 32 and covers 36 but also other similar containers and their contents stacked thereon.

End panels 22 may be pivotally displaced inwardly and upwardly for collapse if shipping container 10 is empty. Once panels 22 have been displaced around their hinge 18 into a position generally horizontal and parallel to bottom member 12, side panels 24 and 26 may be folded and displaced inwardly toward the interior chamber of shipping container 10 around hinges 28 and 34, respectively. Hinge 27 provides necessary pivotal movement between side panels 24, 26 and top frame 32 and thus will be lowered toward bottom member 12.

The features of collapsible shipping container 10 described thus far are conventional in that they may be found in some form in collapsible shipping containers of various manufacturers. A container similar to the one described thus far may be acquired from Monoflo International Inc. of Winchester, Va. As one of skill in the art will appreciate, collapsible containers are very efficient for shipping and return for reuse. Large quantities of this type of collapsible shipping container are utilized to efficiently reduce return shipment costs which are significant inasmuch as the container may be reduced to approximately one-fourth its erected height for storage or return shipment.

Collapsible containers, such as described above, are particularly usefull and beneficial for shipping either bulk types of items or items which are individually packaged and not subject to damage by contact with other packaged goods. However, should the container 10 be used to ship unpackaged items, interior dunnage may be required to separate and protect the items, such as electronic circuit boards, from contact between themselves as well as to prevent buildup of damaging electrostatic charges.

It is important that items such as electronic circuit boards or electronic components be shipped from their point of manufacture to a point of assembly without individual packaging in order to eliminate the cost of such packaging and associated labor necessary to package and unpack the items. Individual protective packaging of the items shipped is not only expensive, individual package costs and productivity drops combine for an overall higher cost for the manufactured device.

Frequent replacement of conventional dunnage such as matrix corrugated fiberboard dividers can be expensive and necessitated by ordinary shipment, handling or damage. Further, matrix corrugated fiberboard dividers do not collapse into a small enough volume to fit within and remain associated with its advantageously collapsed container.

Figure 2:
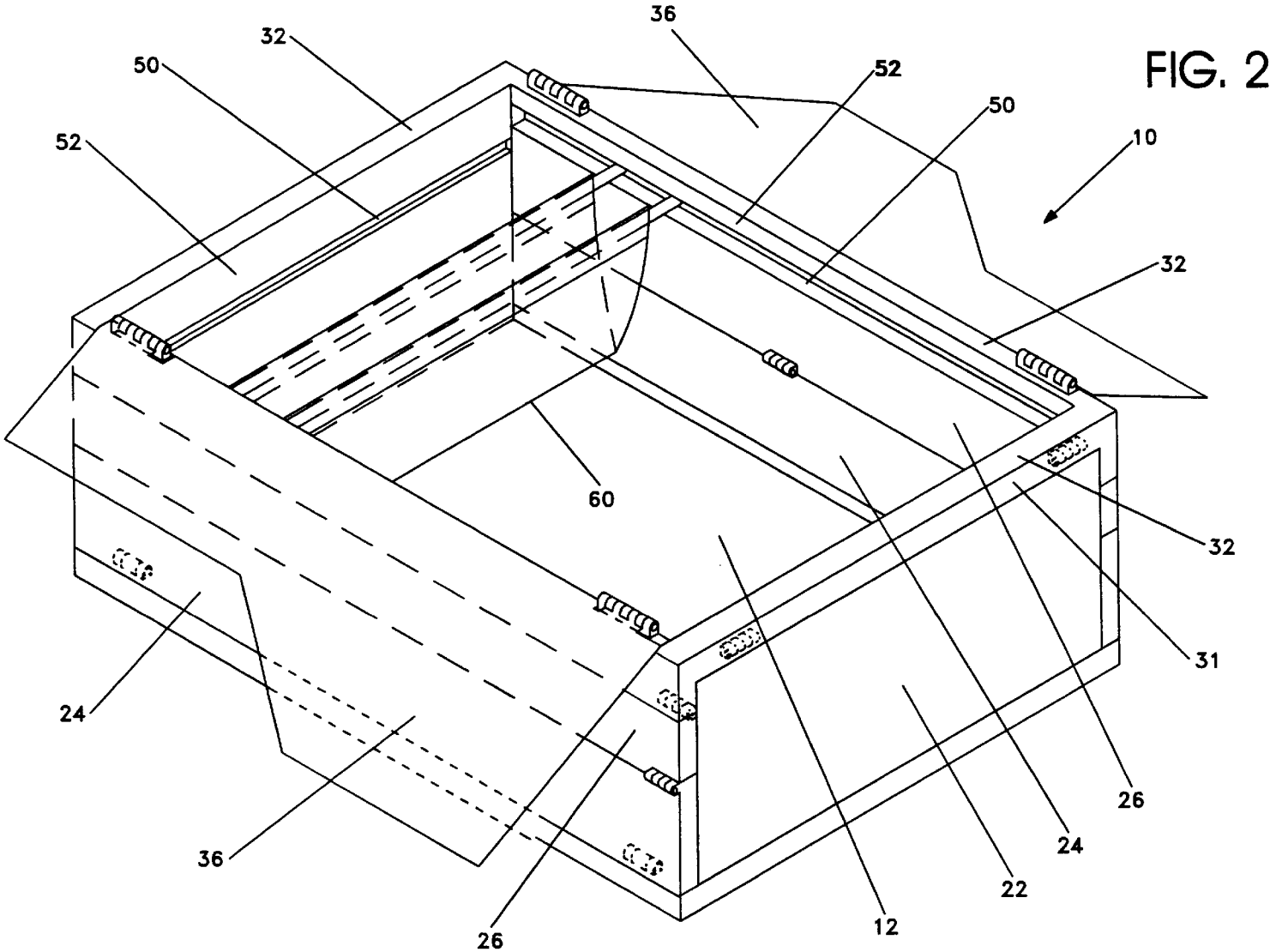
FIG. 2 illustrates the collapsible shipping container of FIG. 1 in an open state with dunnage illustrated suspended within the interior of this container.

Referring now to FIG. 2, covers 36 are illustrated in an open position and expose to view the interior of the collapsible container 10. Container 10 is illustrated in its fully erected state with only a single pouch dunnage divider 60 detailed for clarity.

In order to support dunnage divider 60, top frame 32 is fabricated with a slot 50. The preferred configuration of slot 50 is a "T" shape with the crossbar of the "T" oriented vertically within the top frame member 32. For flexibility in shipping dissimilar items, the "T" shaped slots 50 may be formed into all four sides of top frame 32 and the container reconfigured with only a change in the dunnage.

Similarly, slot 50 may be formed into opposing segments 33. The vertical bar of the "T" shaped slot 50 opens through interior surfaces 52 of at least two opposing side segments 33 of top frame 32. Due to orientation, slot 50 is shown only in one of each pair of the opposing segments. Slot 50 may be provided prior to assembly either in the molding process or cut with a router type bit in either a router or a milling machine during manufacture. Assuming adequate economies of scale, the molding operation may prove to be superior from a cost standpoint.

When slots 50 are formed into all four sides of top frame 32, slots 50 in the end segment 31 of top frame 32 are disposed at a different elevation than the slots 50 in side segments 33 of top frame 32. As an additional advantage, this arrangement permits use of intersecting sets of dunnage as will be described below.

Erection of container 10 is accomplished by lifting top frame 32 away from bottom member 12 and returning end panels 22 and side panels 24, 26 to their vertical orientation. Latch or catch surfaces (not shown) may be used to maintain all side and end panels 24, 26, 22 in their erected orientation for handling and use. End panels 22 will serve as compression members and thus support top frame 32 in its erected position. The support of top frame 32 by end panels 22 will prevent the collapse of top frame 32 downwardly toward the bottom member 12 of the collapsible shipping container 10.

Figure 3:
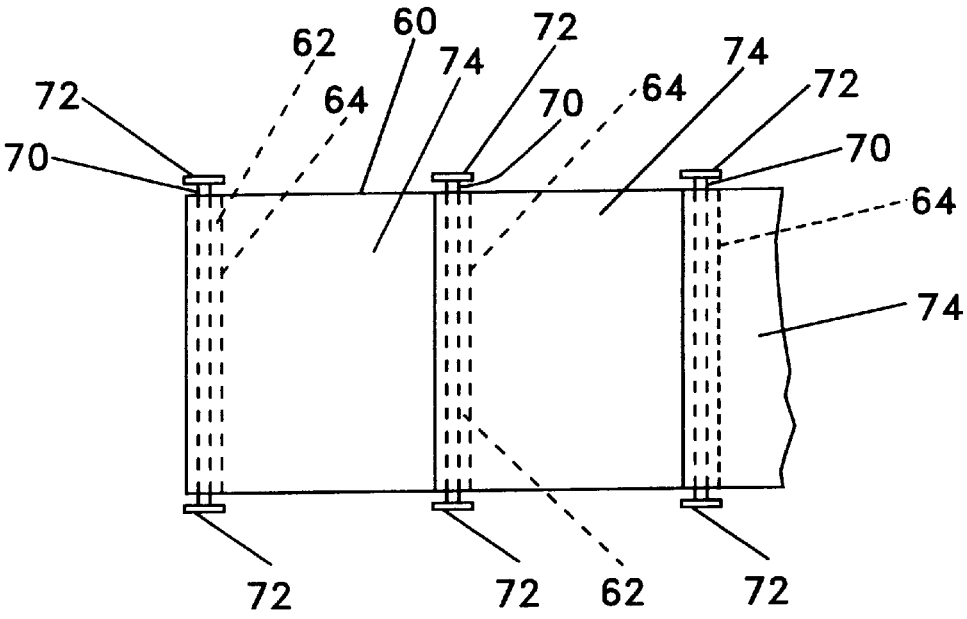
FIG. 3 illustrates the interior dunnage extended to show construction details.

Referring now to FIG. 3, dunnage in the form of dividers or separators 60, as discussed for use in this invention, may be fabricated of flexible material and, as needed, may be electrostatically protective. Dividers 60 advantageously can be formed by creating tubes 62 of the divider material, preferably by folding over the material at selected intervals and joining the juxtaposed surfaces at contact zone 64 by any suitable process. Possible processes for joining include gluing, heat sealing, sewing or stitching, and ultrasonically bonding. The tubes 62, so formed, will each accommodate a suspension rod 70.

Permanent flanges 72 are fabricated on both ends of suspension rods 70. The flange 72 may be formed on the suspension rod 70 by an appropriate forming process or may be attached by welding, brazing, or soldering onto the suspension rod 70 an appropriate sized washer or disk, thereby creating a flange 72.

An alternative to the circular flange 72 is a bar attached across the end of rod 70 forming a "T" shape. The flexible material then must be attached to rod 70 to orient the "T" crossbar perpendicular to slot 50 once the flexible material hangs within erected collapsible container 10. This embodiment provides an easy way to change or replace dunnage 60 as the need arises.

In order that the support rod 70 be freely movable along the length or width of the collapsible shipping container 10, the support rod 70 must be smaller than the width of the stem of the "T" shaped slots 50 and the flanges 72 similarly somewhat smaller than the crossbar of the "T" shaped slot 50. This insures that the flanges 72 and support rods 70 have clearance to be freely movable.

Figure 4:
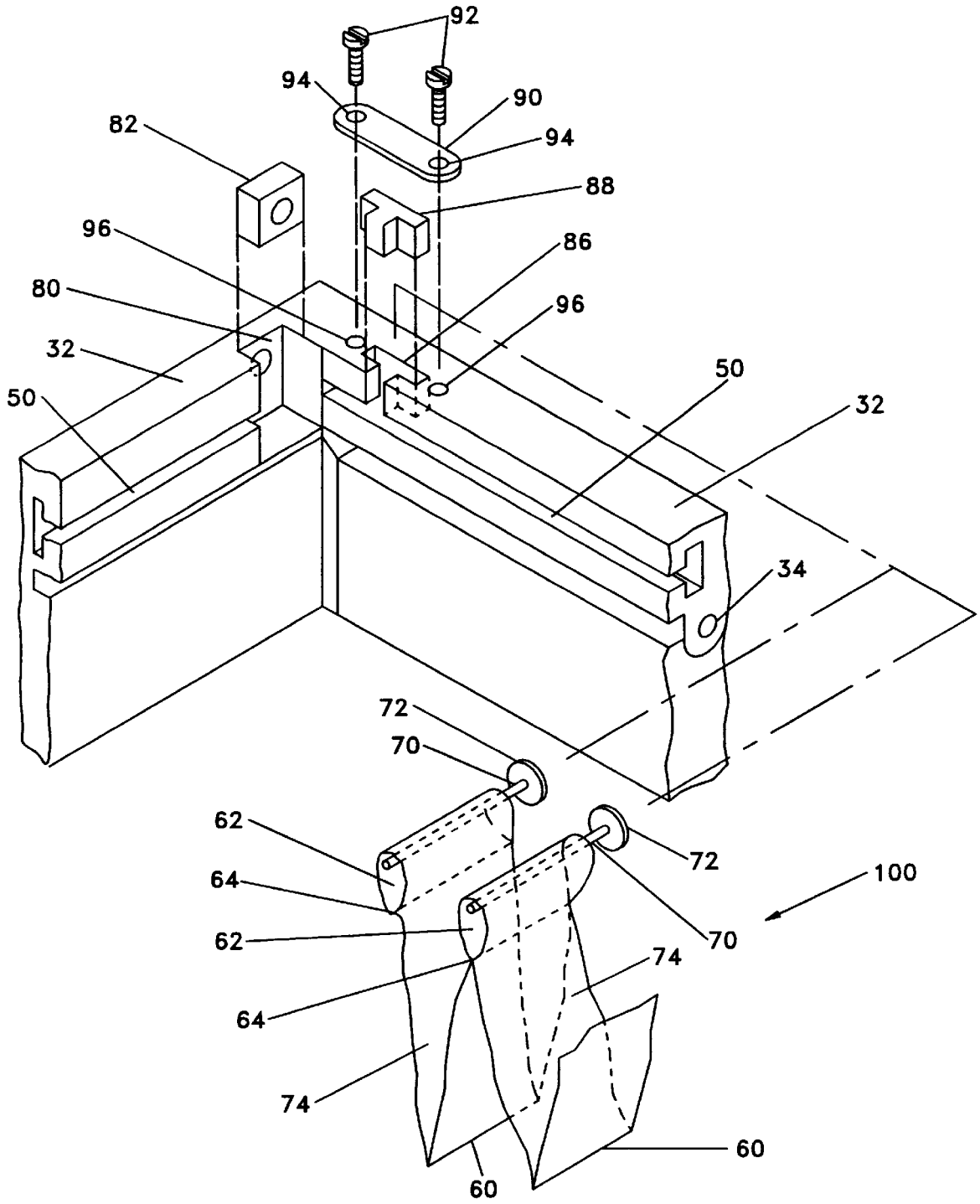
FIG. 4 is a partially exploded detailed illustration of the interior of the side walls of the shipping container and dunnage showing channels which support the dunnage, as well as three embodiments for retaining the dunnage support rods in the channels.

As may be observed in FIG. 4, top frame 32 is fabricated with an access channel 80 formed to intersect with and expose one end of the "T" shaped channel 50. Flanges 72 and support rods 70 of dunnage dividers 60 then may be engaged within channel 50 and slid along channel 50. Additional flanges 72 and rods 70 may be added to provide a plurality of segments 74 arranged suspended from support rods 70. A block 82 may be inserted into channel 80 and fastened therein by a screw or other retainer (not shown) in order to prevent any disengagement of flanges 72 and support rods 70 from channels 50.

As many segments 74 of the dividers 60 may be ganged or made in a single dunnage assembly as desired, and typically the number of segments will be determined by the bulk of the objects or items being packaged therein for shipment. Although this will tend to customize a collapsible shipping container 10 to use for a particular part or time, simply changing the dunnage dividers 60 will re-adapt the container 10 to use for shipment of a different item. Much of the efficiency of use of such containers 10 is due to the frequent usage of a particular combination of container 10 and dividers 60 as handled between a paired shipper and receiver.

Slots 50 in top frame 32 are illustrated at different elevations in FIG. 4 as discussed previously. While having the slots 50 at different levels in top frame segments 31, 33 is not required, flexibility in dunnage adaptation is provided without additional costs of manufacture or retrofit.

Flanges 72 and support rods 70 are engaged into opposed channels or slots 50 and are slidably movable along slots 50 for ease in loading and unloading and adapting the pouch 76 to the items being shipped. The items being shipped then may be inserted into an expanded segment 74 of suspended segments 74 of dividers 60.

FIG. 4 further illustrates additional embodiments of the channel 86 and an element for accessing slot 50 and blocking removal of rods 70 and flanges 72 from slots 50. A further "T" shaped slot 86 may be cut or formed into top frame 32 orthogonally intersecting slot 50. Slot 86 permits insertion of rods 70 and flanges 72 into slot 50. The egress of rods 70 and flanges 72 from slot 50 is denied by "T" shaped plug 88 which fits within "T" shaped slot 86.

Plug 88 may be frictionally retained or may be retained in position by plate 90 which is disposable over slot 86 and further retained by fasteners such as screws 92 engaged through holes 94 of plate 90 and with screw holes 96 in top frame 32.

Where it is desirable to transport relatively large, generally flat items such as printed circuit boards, either populated or unpopulated, the orientation of the dividers 74 or dunnage 100 may be selected to extend across or lengthwise of container 10 as desired and permit insertion of one printed circuit card into each segment 74 or pouch 76 which closely fits the items shipped.

However, there are times when smaller sized items are to be shipped and if more than one such item is loaded into a single pouch 76 of dunnage 100, damage may occur to either or both items. In this circumstance the items must be protected from shifting into positions whereby contact between items can occur with damage sustained by one or both of the items making contact.

Figure 5:
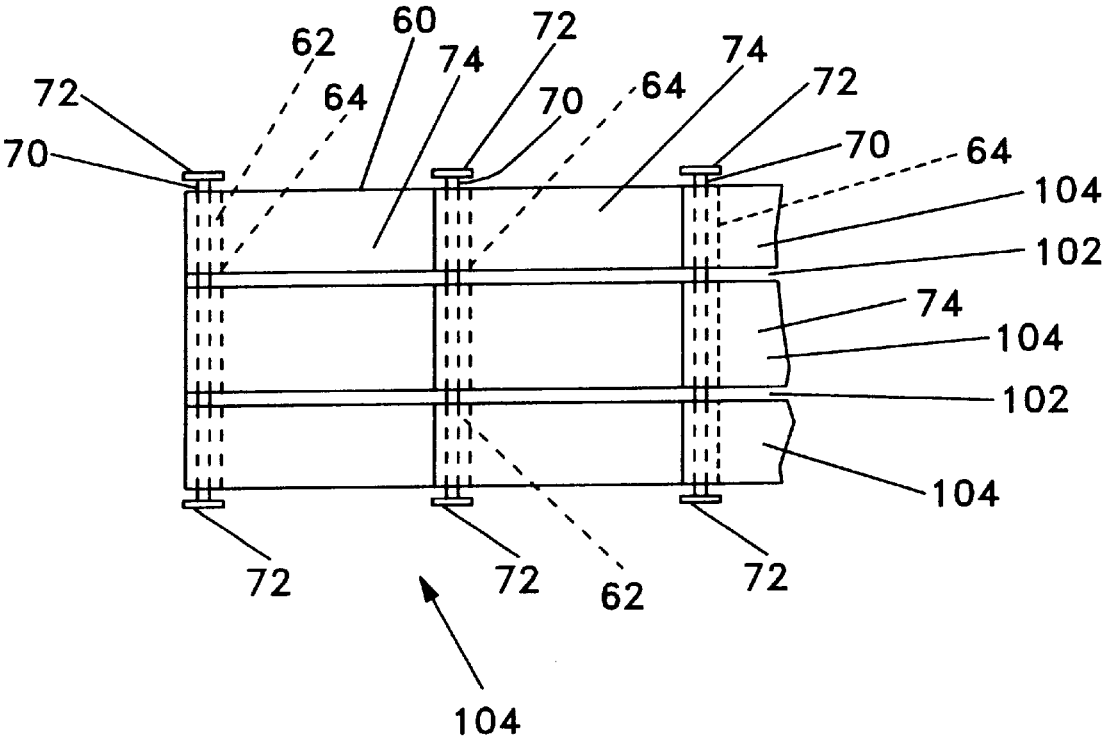
FIG. 5 is an illustration of dunnage suitable for use in the collapsible shipping container of FIGS. 1, 2 and 4 wherein the collapsible shipping container is to be subdivided into a matrix of pouches.
Figure 6:
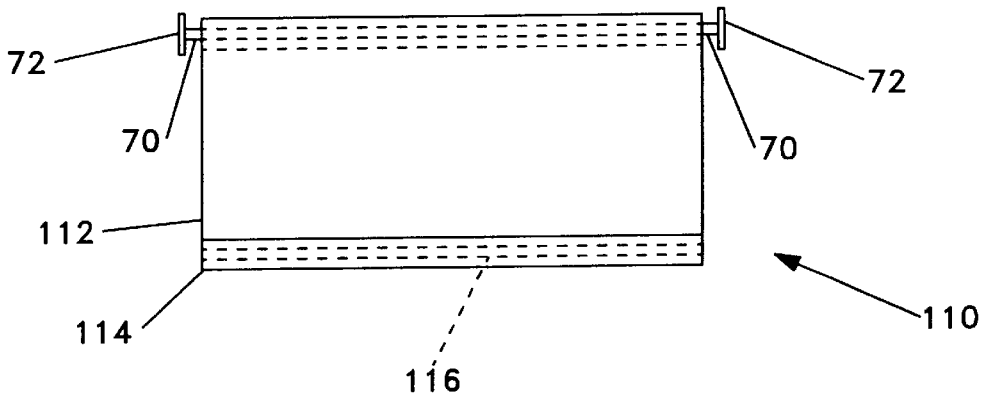
FIG. 6 is an illustration of a dunnage curtain which can be installed in the collapsible shipping container of FIGS. 1, 2 and 4 along with the dunnage illustrated in FIG. 5, thereby forming a matrix of individual pouches.

This protection may be accomplished by using a second set of dividers, such as seen in FIG. 6, where the flexible material of the divider 60 of FIG. 3 is cut or segmented. FIG. 5 best illustrates segments 74 of dunnage 101 wherein the pellicle of material is severed at 102 to leave three dividers 104 on rods 70.

FIG. 6 illustrates a curtain type divider 110 where rod 70 and flange 72, identical except for length to the like-numbered elements in FIGS. 3, 4 and 5, extend through a tube 62 of the curtain material supporting curtain 112. The opposing edge of curtain 112 is similarly formed into a tube structure 114 with weighting rod 116 inserted therein. Weighting rod 116 need only be heavy enough to maintain curtain 112 extended while in use.

Figure 7:
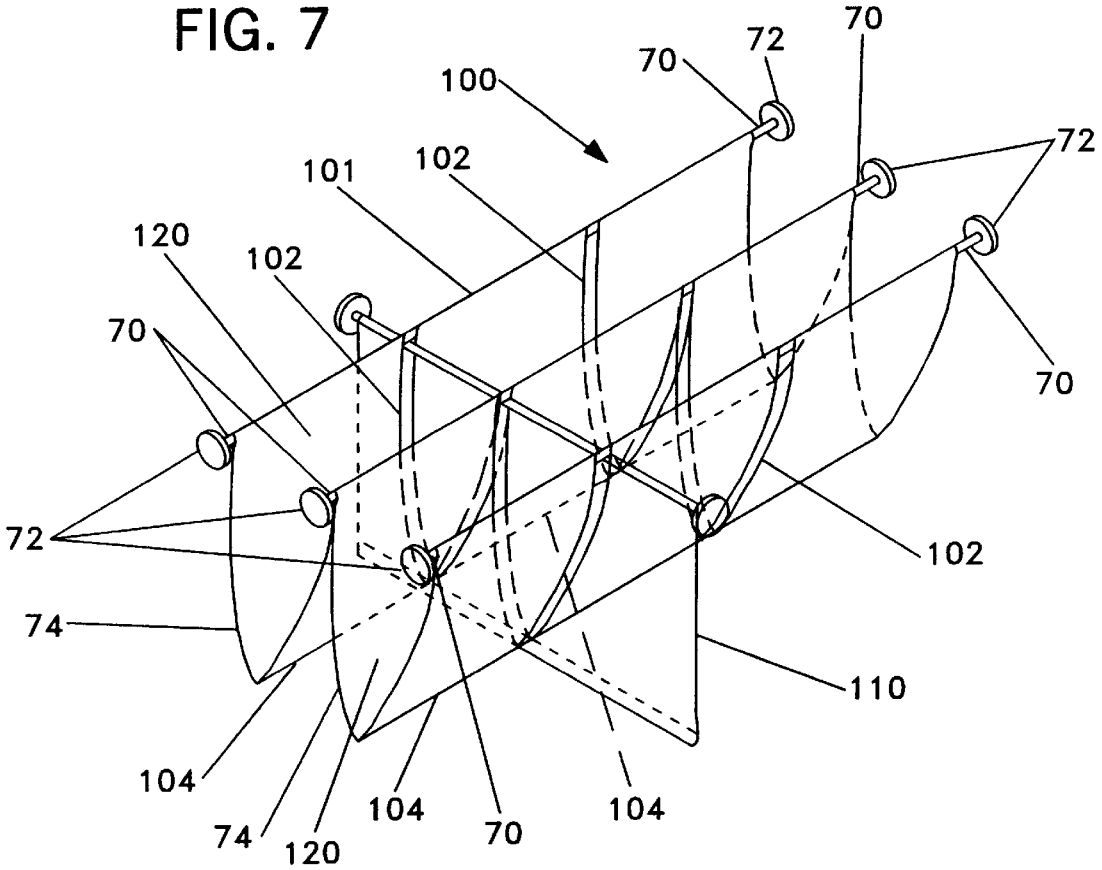
FIG. 7 illustrates the arrangement of the dunnage of FIGS. 5 and 6 creating the individual pouches.

The suspension rods 70 and flanges 72 of curtain 110 shown in FIG. 6 are preferably inserted into slots 50 having the lowest elevation relative to the erected height of collapsible shipping container 10, as earlier mentioned; meanwhile, as illustrated in FIG. 5, the dunnage 101 is installed into and slides within those slots 50 having the highest elevation. This arrangement of the dunnage 101, 110 is shown in FIG. 7. Thus, the support rods 70 of dunnage 101 in FIG. 5 will slide above rods 70 of dunnage 110 or curtains 110 creating smaller compartments or pouches 120 for the items being shipped. Weighting rod 116 will keep curtain 112 extended, thereby separating pouches 120.

Whenever container 10 is collapsed as previously described for storage or return shipment the dunnage 101, 110 may be gathered and the dividers pulled upwardly and laid flat onto collapsed side panels 24, 26 and end panels 22.

To prepare for usage, container 10 is erected and segments 74 of dunnage 101 lifted to permit spreading of curtains 110 across the interior of container 10. When the curtains 110 are positioned as desired across container 10, dunnage 101 may be spread and segments 74 dropped between curtains 110 to form pouches 120 as illustrated in FIG. 7.

Dunnage 101 may be made to provide as many or as few segments 104 as desired and mated with an appropriate number of curtains 110 to form a matrix of separated pouches 120, as illustrated in FIG. 7. Further, curtains 110 may be made of a semi-rigid or rigid material if the material is thin enough to permit complete collapse of the container 10 and the items packed and transported will not be damaged by contact with the curtain material itself.

FIG. 7 illustrates a two-segment dunnage 101 with two severances or gaps 102, orthogonally arranged relative to dunnage 101, and is shown with a single dunnage curtain 110 residing in one gap 102. The illustration of only a single curtain 110 is for purposes of clarity and simplicity. One of skill in the art will understand that an additional curtain will form two additional pouches and the number may be increased with additional segments 74 and curtains 110. Accordingly, pouches 120 may be sized to accommodate any desired part or item for separated shipment.

Being reusable, the container 10 is very cost effective. Container 10 is particularly advantageous for the transport and shipment of electronic circuit boards if the material used for dunnage 100, 101, 110 is protective against electrostatic discharge and the dunnage 100, 101, 110 is maintained with the collapsible shipping container 10, and protected by the collapsed shipping container 10 during periods of non-use and its return shipment to the prior shipper of the electronic circuit boards or other electronic devices.

With a change of dunnage material to fiber board, plastic sheeting or fabric, the container 10 may be adapted for shipment of mechanical parts or assemblies which do not require electrostatic discharge protection, but which require a more substantial divider yet may be collapsible within the container.

While each element of the assemblies shown in the several figures may not be described or addressed in respect to every figure, common reference numerals refer to common elements and the description of an element with regard to one figure may be applied to other figures in which a common element appears.

One of skill in the art will recognize that changes in the invention in addition to the various embodiments described herein may be made without removing the devices and system from the scope of protection afforded by the attached claims.

I claim:

1. A reusable collapsible shipping container with collapsible dunnage comprising:

a bottom panel;

four side walls forming a chamber having an open top;

a frame member surrounding said open top of said chamber;

a cover assembly mounted on said frame for pivotal movement;

said side walls comprising a first pair of opposing wall portions, said pair of wall portions pivotally displaceable to a position permitting repositioning of said frame toward said bottom panel;

said side walls further comprising a second pair of opposing wall portions collapsible to a position permitting said repositioning of said frame;

said frame formed to comprise at least a pair of channels, said channels having a channel opening to said chamber; and collapsible dunnage interior to said chamber, said dunnage comprising support members extending between opposing channels of said at least a pair of channels and separator members depending from said support members for separating items placed within said shipping container for transport.

2. The reusable collapsible shipping container with collapsible dunnage of claim 1 wherein said at least one of said pairs of side walls is pivotally disposed on said frame.

3. A reusable collapsible shipping container with collapsible dunnage comprising:

a bottom panel;

four side walls forming a chamber having an open top;

a frame member surrounding said open top of said chamber;

a cover assembly mounted on said frame for pivotal movement;

said side walls comprising a first pair of opposing wall portions, said first pair of wall portions pivotally displaceable to a position permitting repositioning of said frame toward said bottom panel;

said side walls further comprising a second pair of opposing wall portions collapsible to a position permitting said repositioning of said frame;

said frame formed to comprise at least a pair of channels, said channels having a channel opening to said chamber; and collapsible dunnage interior to said chamber, said dunnage comprising support members extending between opposing channels of said at least a pair of channels, said support members comprise rods with a pair of ends, said ends forming enlarged terminus portions, each of said enlarged terminus portions disposed within one of said channels and separator members depending from said support members for separating items placed within said shipping container for transport.

4. The reusable collapsible shipping container with collapsible dunnage of claim 3 further comprising a removable retaining member disposed to block at least one of said channels, thereby preventing said enlarged portions of said dunnage support members from being removed from said channels.

5. The reusable collapsible shipping container with collapsible dunnage of claim 4 wherein said second pair of side walls is pivotally attached to said bottom panel.

6. The reusable collapsible shipping container with collapsible dunnage of claim 4 wherein said separator members are flexible and form at least partial pouches for containing articles for shipment.

7. The reusable collapsible shipping container with collapsible dunnage of claim 6 wherein said separator members comprise a pellicle of electrostatic protective material.

8. The reusable collapsible shipping container with collapsible dunnage of claim 4 wherein said separator are flexible and form at least partial pouches for containing articles for shipment.

9. The reusable collapsible shipping container with collapsible dunnage of claim 8 wherein said pellicle of electrostatic protective material is attached to itself forming tubular portions through which said dunnage support members extend between said channels on opposing segments of said frame.

10. The reusable collapsible shipping container with collapsible dunnage of claim 8 wherein said separator members comprise a pellicle of electrostatic protective material.

* * * * *